United States Patent [19]

Needt

[11] 3,934,747

[45] Jan. 27, 1976

[54] CONTAINER, PARTICULARLY FOR LIQUIDS

[75] Inventor: Jan Henrik Needt, Oosterhout, North Brabant, Netherlands

[73] Assignee: Wiva N.V., Rotterdam, Netherlands

[22] Filed: Sept. 6, 1974

[21] Appl. No.: 503,908

[30] Foreign Application Priority Data

Sept. 10, 1973 Netherlands ..... 12477

[52] U.S. Cl. ..... 220/5 R; 220/72

[51] Int. Cl.[2] ..... B65D /702

[58] Field of Search ..... 220/5 R, 9 E, 72, 74, 75, 220/76, DIG. 1

[56] References Cited

UNITED STATES PATENTS 2,798,631 · 7/1957 Engel ..... 220/76 X

*Primary Examiner*—George E. Lowrance
*Assistant Examiner*—Steven M. Pollard
*Attorney, Agent, or Firm*—Alan H. Levine

[57] ABSTRACT

A container, particularly for liquids, consisting of at least two coaxial parts manufactured from synthetic material, wherein each part has a ring which is concentrically connected with the peripheral edge thereof. In the two interconnected parts, both the end edges concerned and the facing edges of the rings are interconnected.

8 Claims, 6 Drawing Figures

CONTAINER, PARTICULARLY FOR LIQUIDS

BACKGROUND OF THE INVENTION

The invention relates to a container, particularly for liquids, consisting of at least two coaxial parts manufactured from synthetic material and interconnected by their peripheral edges.

It is known per se to form containers of synthetic material, e.g., for liquids, from two adjoining and interconnected parts. The Netherlands Patent application 64,14980, describes a container made of plastic and constructed from two tapering parts of which the end edges are outwardly bent over and interconnected by sealing them together.

The Netherlands Patent application 72,05432 proposes a container manufactured from synthetic material and consisting of at least two parts, the two parts being interconnected by means of teeth extending along the circumference and engaging each other.

As to the manufacture of a container from synthetic material, there are only a limited number of processes which are considered.

The process which is mostly and universally followed is extrusion blow molding, wherein an extruded tube is introduced into a divisible die, which tube, after closing the die, is inflated by comprssed air, so that the still pliable tube conforms to the configuration of the die. The compressed air acts as the core of the mold form. In this way it is possible to manufacture hollow articles like vessels and containers in one piece. This process is attractive due to the comparatively moderate die cost, since, contrary to an injection molding process, the die for blow molding has no core and in fact consists only of the outer mold which moreover is not exposed to such high pressure as the injection molding dies.

This method suffers from the disadvantage that there are limitations as to the shape of the finished article, in particular the limited possibility of separately determining the wall thicknesses at various locations.

A cylindrical container with a flat bottom manufactured according to this method has the drawback that on the point of tangency of the shell with the bottom or cover, the extruded tube is more stretched than in the central part or the upper surface and lower surface, respectively.

In practice those locations, i.e., the locations at which the shell merges into the upper or lower surface, are consequently most liable to damage, and if those weak spots should be reinforced, this implies that almost the whole container should be stiffened which involves a certain waste of material.

In order to avoid this more or less excessive blow-out, the bottoms of blown containers are usually constructed in such a way that their diameter is smaller than that of the shell, whereby the surface by which it bears on the ground is not insignificantly reduced which impairs the stability when conveyed by conveyor tracks or other means of conveyance. Although attractive due to low cost of production, the blow molding process has drawbacks which may weigh heavily.

By using an injection molding method it is possible to obtain certain shapes for tube rings and bottoms which, when assembled, constitute a container which at the most damageable locations, in this case the locations at which the shell merges into the upper and lower face and at one or more locations on the circumference of the shell, is provided with reinforcements.

SUMMARY OF THE INVENTION

The invention aims to provide a container structure which does not hamper the manufacture of the vessel by injection molding and which does not render it necessary to use complicated and expensive dies, but which also allows great strength to be easily imparted to the connection between the parts.

The container according to the invention has in each part a ring which is concentrically connected with the circumferential edge thereof, while of two interconnected parts both the end edges concerned and the facing edges of the rings are interconnected.

The concentric ring may be placed outside the related part of the container. According to the invention a reinforcing band of two concentric rings is obtained, the inner ring forming part of the container proper and the outer ring serving as a reinforcement which protects the container from injuries or destruction owing to loads applied thereto when it falls or bumps.

By locally increasing the thickness of the material of this double wall, the strength against the loads referred to above may be adapted according to the requirements by using a minimal quantity of additional material.

In molding the band, ribs can be simultaneously forced in one piece therewith, which are regularly spaced on the circumference and impart an additional stability to the double-walled band and are disposed in such a way that in cases of a point load the forces which are applied to the outer wall of the band are absorbed and to a much lesser extent are transmitted to the container proper. The facing edge parts of the respective ribs may be interconnected. The ring can also, via a closed bridge part, be connected with the wall of the vessel.

When containers are filled under pressure, or when the pressure can increase, e.g., owing to a rise in temperature of the contents of the vessel, the reinforcing bands limit the deformation of the container so that it can still be rolled.

A container may also be constructed such that each container part carries at both ends a concentric ring, while the container constructed from interconnected parts is closed at both ends by cover parts provided with a corresponding ring. The construction may be such that the inside diameter of each part decreases gradually from the two ends to the central part, while the container is composed of a number of interconnected parts.

Containers made of synthetic material in the conventional structures tend to sag when they are horizontally placed on the ground, whereby a steadily increasing flat side forms on the shell at the location where it contacts the ground or floor.

When cases are stored this is a drawback, since after a lapse of time the deformation is such that the container can only be rolled with difficulty.

The reinforcing rings according to the invention allow the vessels to be rolled over guide booms or rails, as is usual with metal vessels, the protruding reinforcing ring serving as a flange wheel causing the container to track along the rails or guide beams.

Since the container is provided with upper and lower surfaces with a diameter which is at least equal to that of the shell, better stability in vertical stacking is achieved than is possible in the case of blown containers with reduced upper and lower surfaces. The container can also take a higher axial load, with the same use of material, than is the case with blow-molded containers, which is of interest for consumers and shippers.

Figure 1:
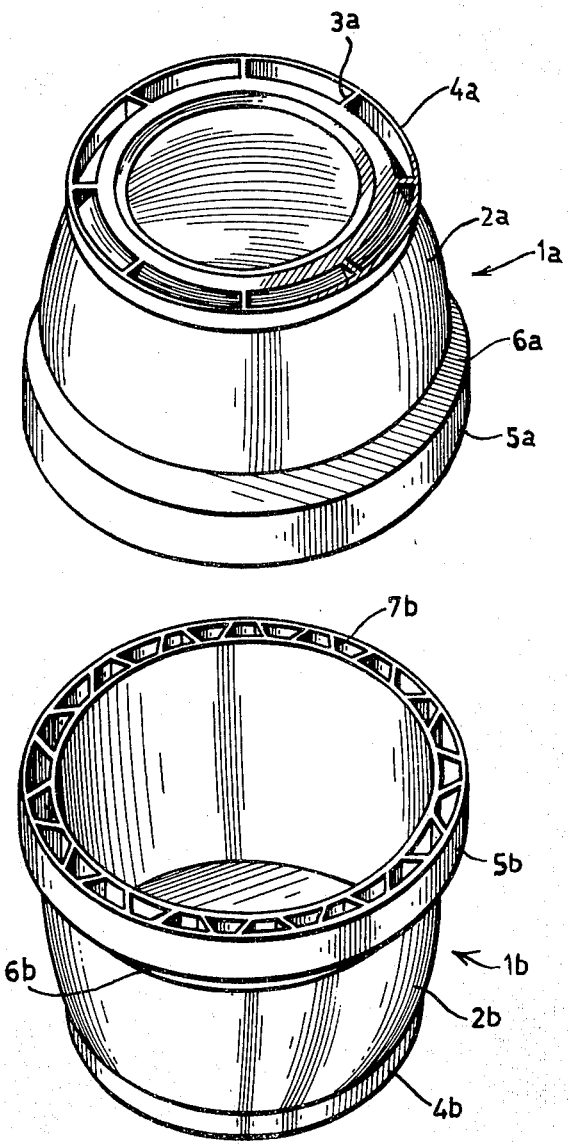
FIG. 1 is a perspective view of a container, according to the invention, which is composed of two parts.

DESCRIPTION OF PREFERRED EMBODIMENTS:

The container depicted in FIG. 1 consists of parts 1*a*, 1*b* manufactured from synthetic material by injection molding. The two parts are identical; each consists of a shell portion 2*a*, 2*b*, respectively, which via ribs 3*a* is connected with the edge 4*a*, 4*b*, respectively. According to the invention the parts are interconnected in a special way. At the open end of each of the parts 1*a*, 1*b*, respectively, is disposed a ring 5*a*, 5*b*, respectively, concentric therewith, which via both a closed bridge part 6*a*, 6*b*, respectively, and a plurality of ribs 7*b* is connected with the associated shell portion. The two parts may be interconnected by means of the well-known "mirror molding" process. The parts to be interconnected are smoothed by means of a rotating milling cutter; thereupon the edges are heated by means of the sealing mirror and, after the mirror has been removed, pressed one on the other. It is ensured that the corresponding facing edges on the ribs 7*a*, 7*b* of the two container portions are sealed together.

Thus, a structure is produced which not only has the advantage of providing a proper connection of the two parts of the container, but which, moreover, as a rolling and protective edge, give these parts an additional protection.

Since the corresponding end edges of the ribs of the two parts 7*b* are interconnected, a plurality of air chambers is forced which damp shocks and sudden loads on the rolling edges.

Figure 2:
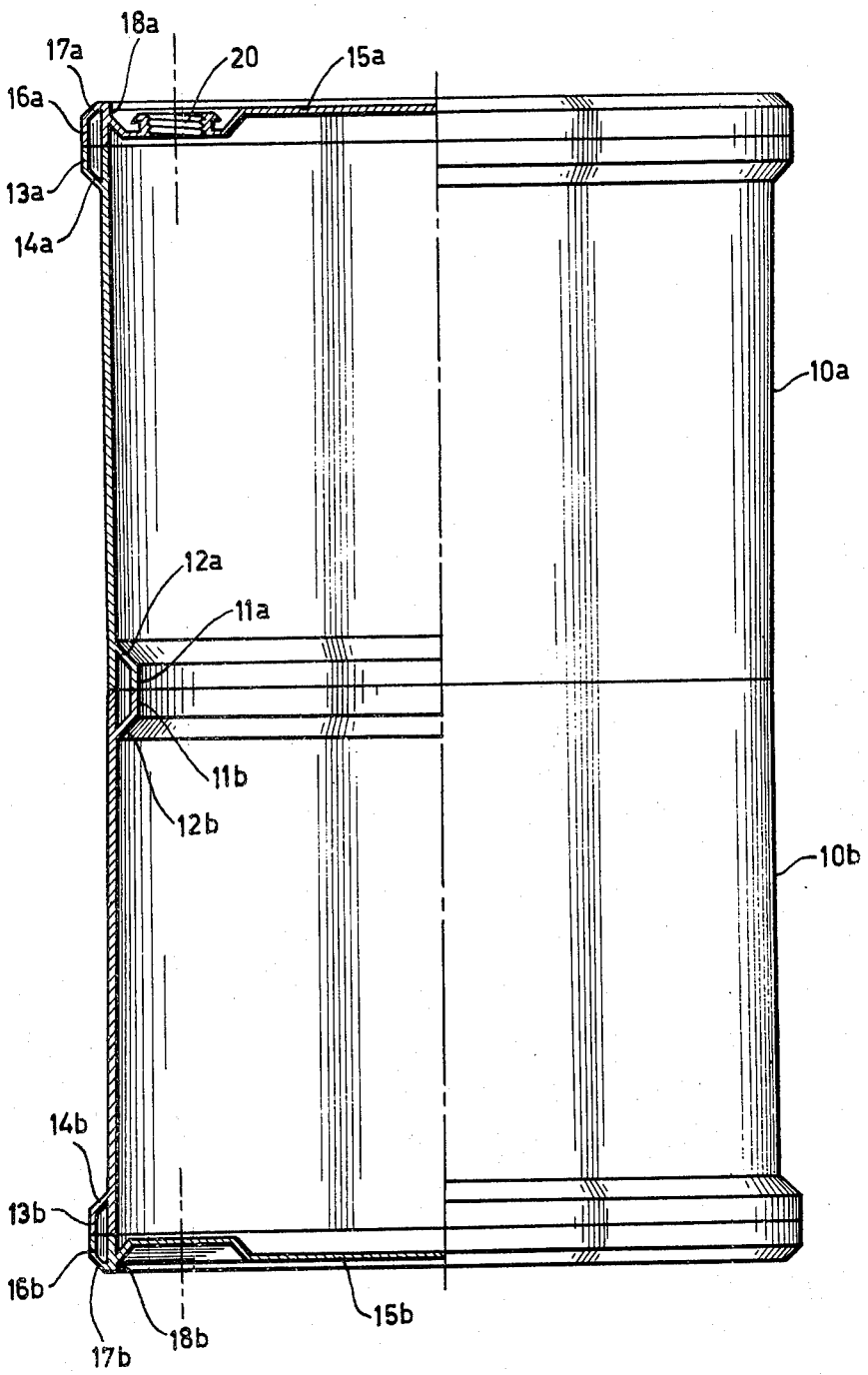
FIG. 2 is partially an elevational view and partially a longitudinal section through a vessel constructed from two shell parts and two cover parts.

FIG. 2 shows partially in section and partially in elevation a container constructed from two shell parts and two cover parts. The shell parts 10*a*, 10*b* are identical. Their diameter decreases slightly, in order to allow removal from the injection molding die, from the respective outer ends toward the central part. The facing ends of the shell parts 10*a*, 10*b* are provided with edges 11*a*, 11*b* concentric thereto and situated inwardly therefrom, the edges being connected, via the bridge parts 12*a*, 12*b* and the ribs (not shown) arranged as shown in FIG. 1, to the wall of the container. At the ends remote from each other are rings 13*a*, 13*B*, respectively, on the outer side of the shell parts 10*a*, 10*b*. They are connected, via the bridge parts 14*a*, 14*b*, respectively, and ribs of the aforementioned kind, to the respective shell parts. The cover parts 15*a*, 15*b*, too, are provided on their outer sides, with rings 16*a*, 16*b*, which, via the bridge parts 17*a*, 17*b* and ribs, are connected to the cylindrical cover part 18*a*, 18*b*, respectively.

Figure 3A:
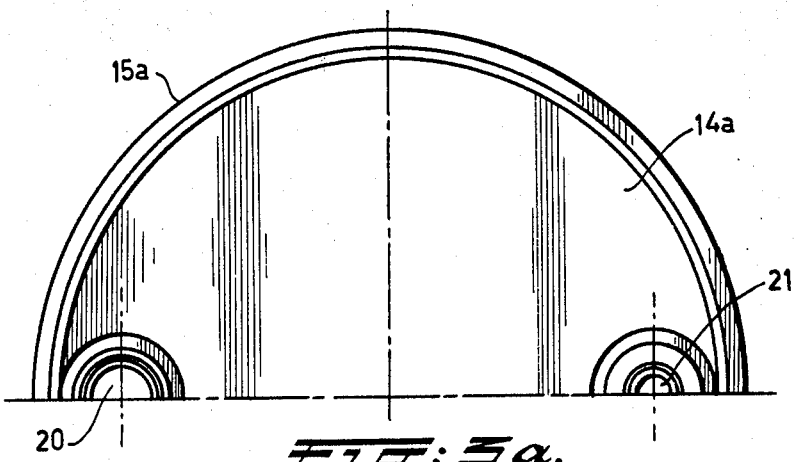
FIG. 3*a* is a fragmentary plan view of a cover part used in a container according to FIG. 2.
Figure 3B:
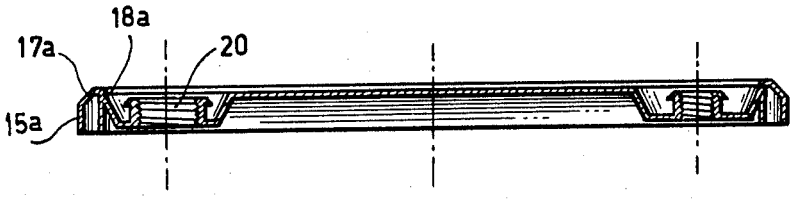
FIG. 3*b* is a longitudinal section of the cover part.
Figure 3C:
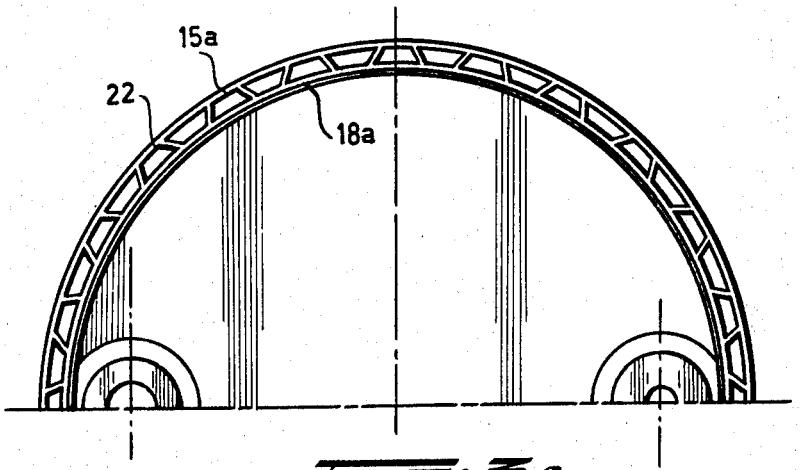
FIG. 3*c* is an inverted plan view of the cover part.

FIGS. 3*a*, 3*b* and 3*c* show a fragmentary plan view, a longitudinal section, and an inverted plan view, respectively, of a cover part like the cover part 15*a*. This part includes a bung hole 20 and an outlet opening 21 used for cleaning the vessel and, as shown in FIG. 3*c*, connecting ribs 22. These ribs are also provided on the container part with which the cover part is connected.

Figure 4:
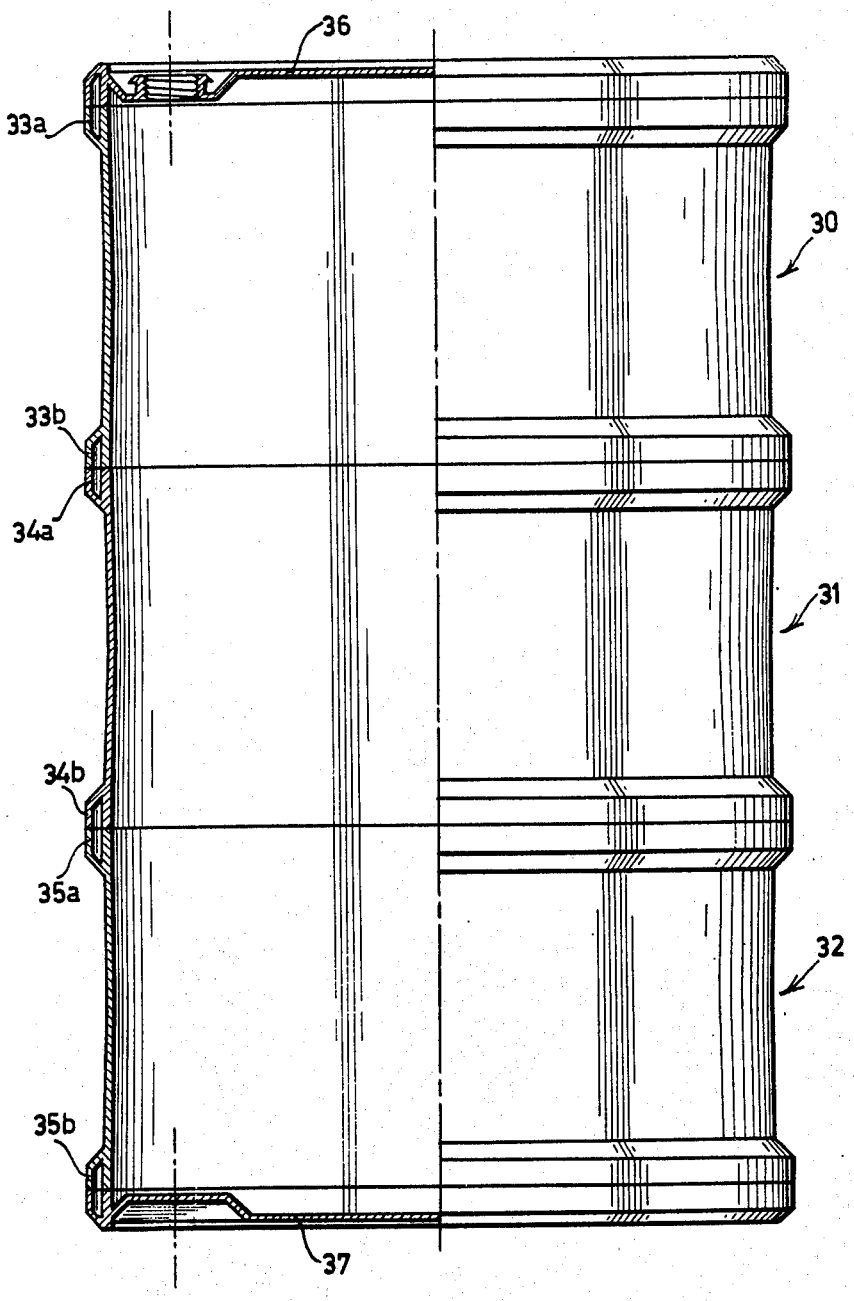
FIG. 4 is partially an elevational view and partially a longitudinal section of a vessel according to the invention constructed from three shell parts and three cover parts.

FIG. 4 shows how it is possible to construct, from a limited number of standard parts, a plurality of vessels with mutually differing volumes.

Each of the parts 30, 31, and 32 is shaped in such a way that the diameter from the two ends toward the central part slightly decreases in order to permit the container to be removed from the die. At the ends of the parts the diameter is mutually identical.

The rings 33*a*, 33*b*, 34*a*, 35*a*, 35*b* are disposed on the outer side of the container in the way described hereinbefore. The two end covers 36, 37 are shaped in the way described with reference to FIG. 2 and FIGS. 3*a* to 3*c*. This container, too, presents the aforementioned advantages.

By spraypainting the parts of the complete container in various colors and assembling these differently colored parts, it is possible to manufacture containers painted in two or more colors. There is a need for such containers by companies which want to use vessels having their "company colors" so that the owner or the contents can be identified by color or combinations of colors.

What is claimed is:

1. A container comprising at least two coaxial shell parts arranged end-to-end and made of synthetic moldable material, each shell part having a ring concentric with its respective shell part and connected to a peripheral edge of its respective shell part, the ring of each part having an edge facing an edge of the other ring, said facing edges engaging each other in only a single plane and being permanently connected to each other.

2. A container as defined in claim 1 wherein each shell part has an end edge facing an end edge of the other shell part, said facing shell part edges engaging each other in only a single plane and being connected to each other.

3. A container as defined in claim 1 including connecting ribs connecting each ring to its respective shell part, said ribs being uniformly distributed around the periphery of the shell part.

4. A container as defined in claim 3 wherein the ribs of each shell part have edges facing the ribs of the other shell part, said facing edges of the ribs engaging each other in only a single plane and being connected to each other.

5. A container as defined in claim 4 wherein each shell part has an end edge facing an end edge of the other shell part, said facing shell part edges engaging each other in only a single plane and being connected to each other, the planes of engagement of said rings, ribs, and shell parts all being the same plane.

6. A container as defined in claim 1 including a solid bridge part connecting each ring to its respective shell part.

7. A container as defined in claim 1 wherein each end of the container is provided with an end ring concentric with the container and connected to the peripheral edge of its respective container end, and including a cover part at each end of the container, each cover part having a concentric ring corresponding to the ring at the container end, said container end ring and its respective cover part ring each having an edge facing an edge of the other, said facing edges engaging each other in only a single plane and being connected to each other.

8. A container as defined in claim 7 wherein the diameter of each shell part decreases from each end toward its center.

* * * * *